US008710985B2

(12) United States Patent
Shao

(10) Patent No.: US 8,710,985 B2
(45) Date of Patent: Apr. 29, 2014

(54) WINE CELLAR ALARM SYSTEM

(75) Inventor: Haoming Shao, Corona, CA (US)

(73) Assignee: Vinotemp International Corporation, Rancho Dominguez, CA (US)

( * ) Notice: Subject to any disclaimer, the term of this patent is extended or adjusted under 35 U.S.C. 154(b) by 160 days.

(21) Appl. No.: 12/418,398

(22) Filed: Apr. 3, 2009

(65) Prior Publication Data

US 2009/0309719 A1 Dec. 17, 2009

Related U.S. Application Data

(60) Provisional application No. 61/060,567, filed on Jun. 11, 2008.

(51) Int. Cl.
*G08B 21/00* (2006.01)

(52) U.S. Cl.
USPC ..... 340/540; 62/157; 340/539.26

(58) Field of Classification Search
USPC ..... 340/540; 62/157
See application file for complete search history.

(56) References Cited

U.S. PATENT DOCUMENTS

| | | | | | |
|---|---|---|---|---|---|
| 4,169,357 | A * | 10/1979 | Kelley | 340/654 |
| 4,742,475 | A * | 5/1988 | Kaiser et al. | 340/538 |
| 5,343,712 | A * | 9/1994 | Gowan | 62/126 |
| 5,626,288 | A * | 5/1997 | Huber | 236/49.3 |
| 6,182,454 | B1 * | 2/2001 | McNeilan | 62/176.4 |
| 6,622,127 | B1 * | 9/2003 | Klots et al. | 705/28 |
| 7,139,637 | B1 * | 11/2006 | Waddington et al. | 700/216 |
| 7,299,644 | B2 * | 11/2007 | Athanasiou et al. | 62/158 |
| 2007/0162358 | A1 * | 7/2007 | Banerjee et al. | 705/28 |
| 2007/0246642 | A1 * | 10/2007 | Millett et al. | 250/221 |
| 2007/0267509 | A1 * | 11/2007 | Witty et al. | 236/51 |
| 2008/0217419 | A1 * | 9/2008 | Ehlers et al. | 236/44 C |
| 2008/0222003 | A1 * | 9/2008 | Adstedt et al. | 705/26 |

* cited by examiner

*Primary Examiner* — Eric M Blount
(74) *Attorney, Agent, or Firm* — Kleinberg & Lerner, LLP; Marvin H. Kleinberg; Marshall A. Lerner

(57) ABSTRACT

A notification device includes wine cellar temperature and humidity sensors, a processing device, an alarm and an automatic telephone dialer that notifies designated recipients when wine cellar temperature and humidity values are outside of preset limits.

13 Claims, 7 Drawing Sheets

WINE CELLAR ALARM SYSTEM

This non-provisional application claims priority from the provisional application filed Jun. 11, 2008 under Ser. No. 61/060,567.

BACKGROUND

1. Field of the Invention

The present invention relates to wine storage and more particularly, to an alarm system that can provide alerts in the event of conditions which could adversely affect the quality of the stored wine.

The present invention refers and relates to a co-pending patent application Ser. No. 11/668,298 for a Wine Cellar Climate Control System.

2. Description of the Related Art

The storing condition for wine is critical to the proper storage and aging of wine. If wine is stored improperly, even if the wine bottle is sealed, it will age unpredictably and its essence will deteriorate. It is essential that not only the storing temperature be controlled at a desired range, but also in the case of the vast majority of wines using corks, the relative humidity should also be maintained within a specified range.

Storing wine in a climate controlled wine cellar is a suitable and economical way of aging and maintaining wine wherein the climate controlled wine cellar includes means to maintain the air temperature and relative humidity at desired values. According to the natural storing climate, most wine cellars are maintained between 50° to 60° F. air temperature and 50% to 70% relative humidity, respectively.

However, in case of a malfunction of the climate control system with which cellar is equipped, the quality of the stored wine could be irreversibly degraded.

Therefore, what is needed and provided with the present invention is a warning system for use with a wine cellar which alerts the user when the temperature or humidity is outside of the desired preset limits. It is an object of the invention to provide a continuous and economical method and apparatus for maintaining the safety of wine in storage.

SUMMARY OF THE INVENTION

In a preferred embodiment of the present invention, the wine owner or his designee is alerted by receiving a telephone call on a cellular or other selected telephone whenever temperature or humidity is beyond the desired levels in a wine cellar. A temperature sensor, a humidity sensor, and a processing device are connected to an automatic dialer (programmed with preselected telephone numbers) which is triggered by the processing device in the event that temperature or humidity levels are outside of preset limits.

The processing device compares values given by the temperature and humidity sensors with predetermined set points to trigger the automatic dialer by either wired or wireless communication methods.

In a preferred embodiment, the automatic dialer will call the owner's cellular telephone, sending a prerecorded warning message. In alternative embodiments, any desired telephone number could be called, such as a repair and maintenance service with a response capability.

In yet other embodiments, an alarm system including lights and/or a sonic alarm can also be activated to signal a malfunction in the wine cellar climate control system.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE INVENTION

Figure 1:
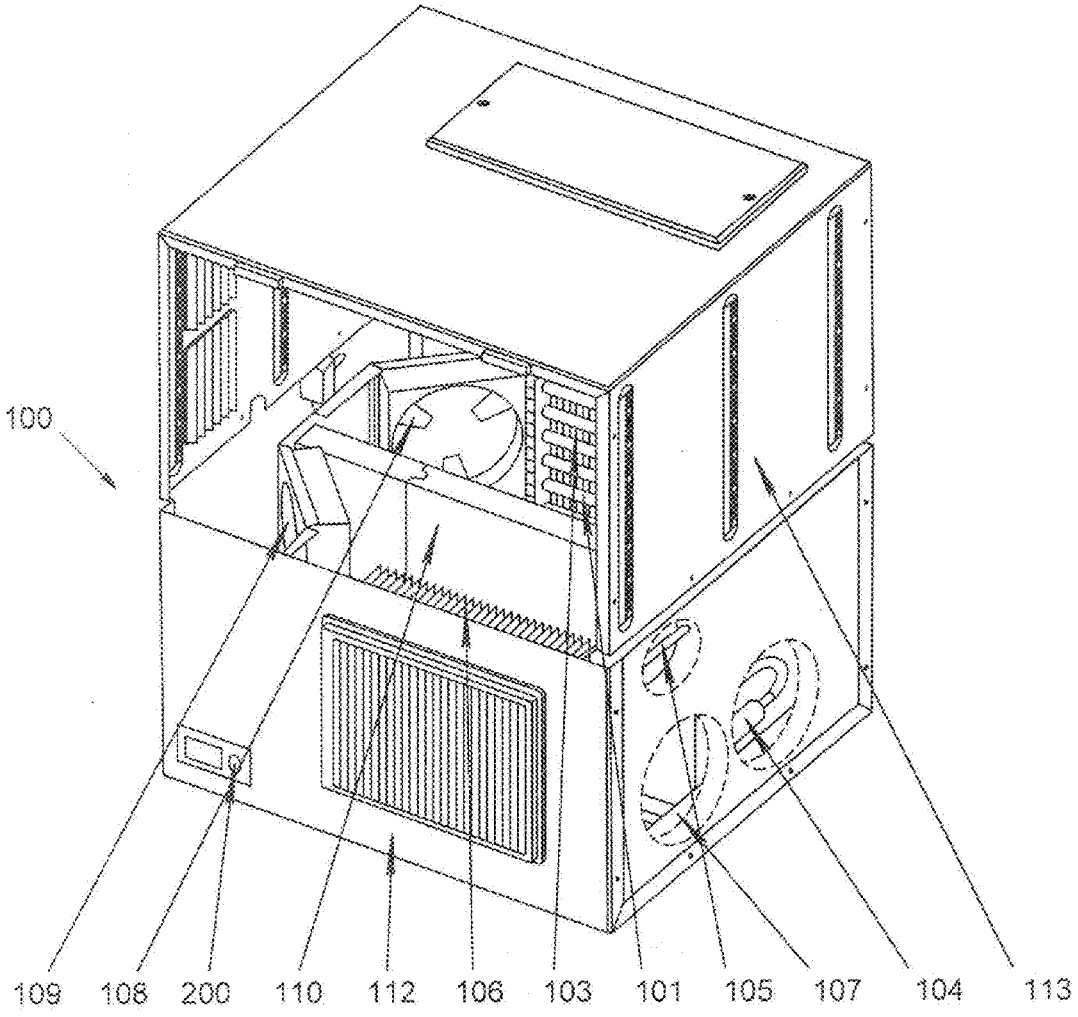
FIG. 1 is a perspective view of the preferred embodiment of the present invention with the upper housing moved up.

The apparatus of the present invention is shown in FIG. 1 (taken from copending application Ser. No. 11/668,298). A refrigeration system 100 is equipped with a programmable controller 200 that has a temperature sensor 203, discussed below in FIG. 3. The refrigeration system 100 includes a conventional vapor-compression system having a compressor 101, a hot gas tube 102 (shown in greater detail in FIG. 2), a condenser 103, a flow control device 105, an evaporator 106, a condensate drip tray 107, condenser fans 108 and evaporator fans 109. Insulation foam 110 is provided to reduce noise and, as noted below, to separate the "cold" side from the "hot" side. The condenser fans 108 exhaust hot air to the exterior of the wine cellar and the evaporator fans 109 send the cooled air into the wine cellar. The system also includes a lower housing 112 and an upper housing 113.

Figure 2:
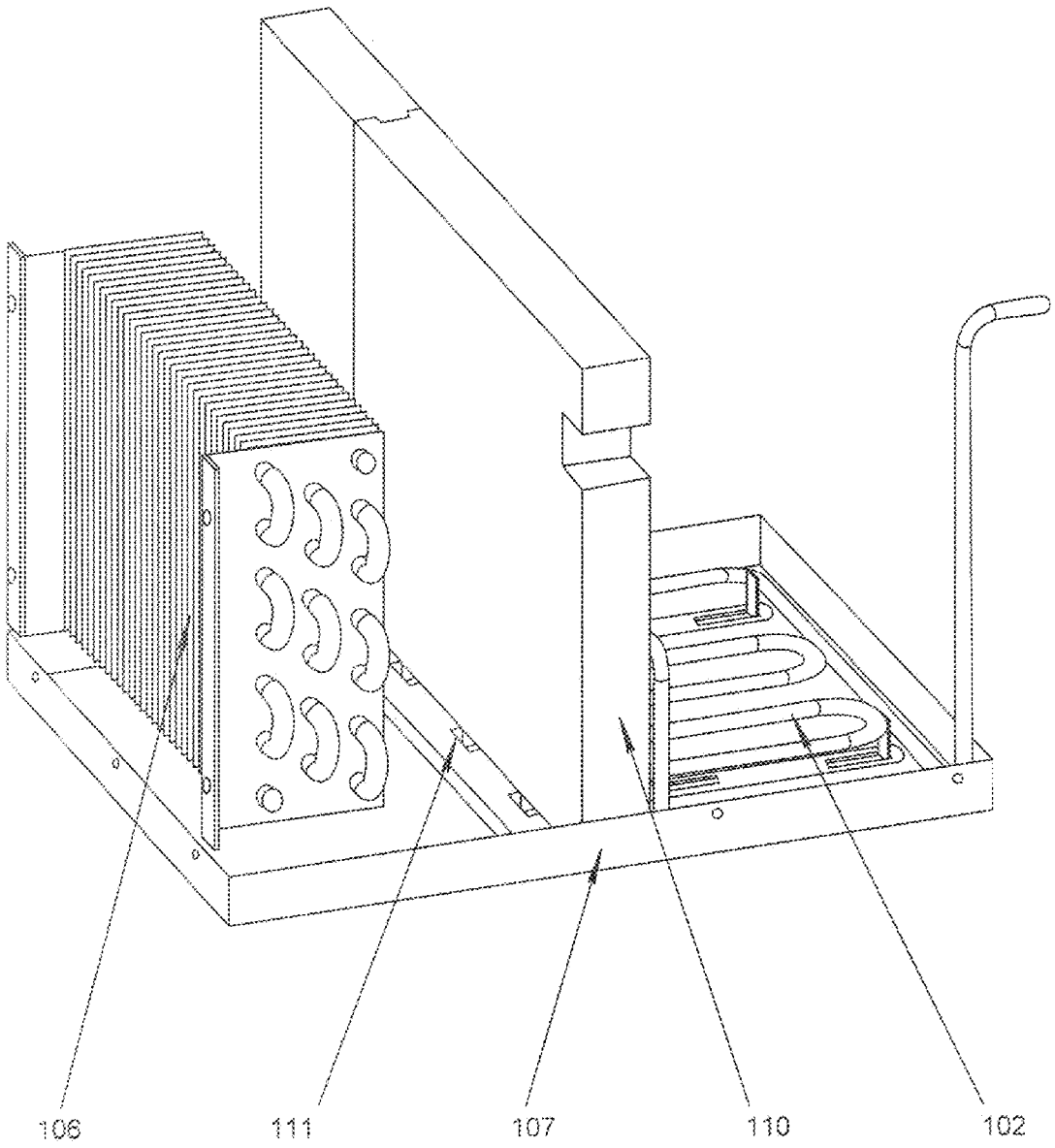
FIG. 2 is a perspective view of the condensate drip tray, over-flow passages, evaporator and hot-gas tube of the preferred embodiment of FIG. 1.

As shown in FIG. 2, the condensate drip tray 107 has over-flow passages 111 for the purpose of preventing flooding and for storing some of the water condensed by and dripped from the evaporator 106. The insulation foam 110 separates the "cold" side and "hot" of the system 100.

Figure 4:
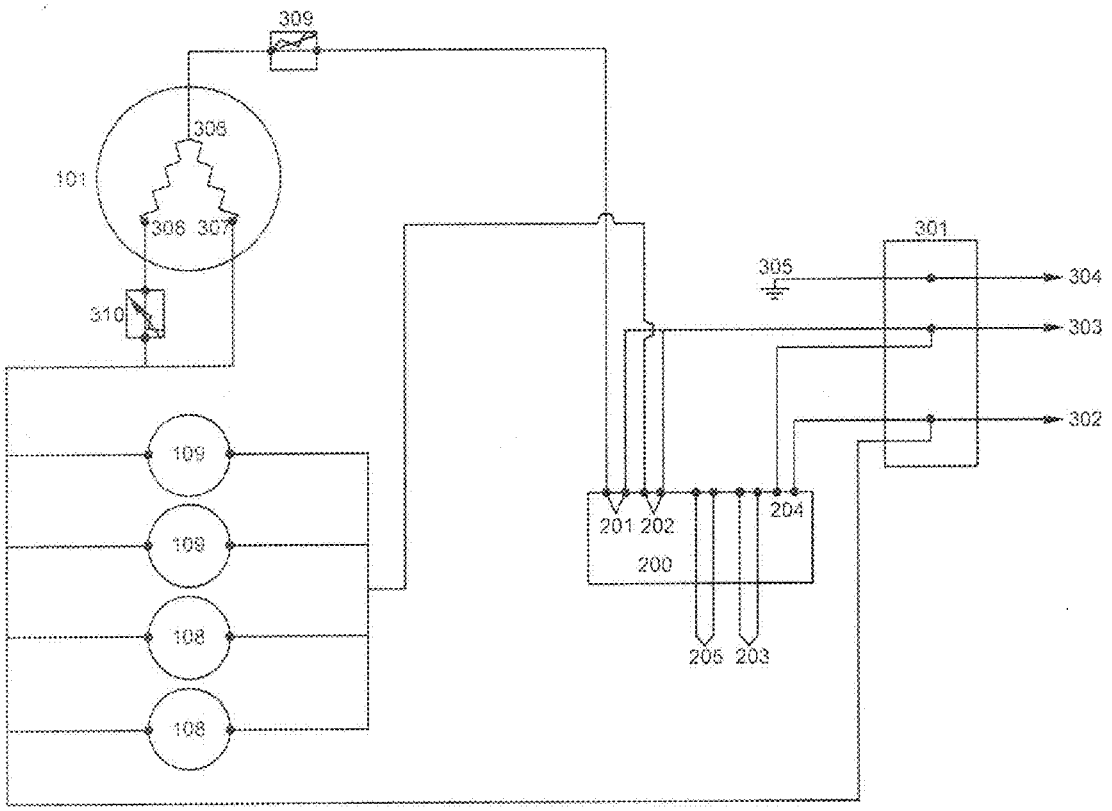
FIG. 4 is an electrical wiring diagram of the refrigeration system of FIG. 1.

The programmable controller 200 in FIG. 1, in the preferred embodiment, provides one relay output 201 for the compressor 101 and the other relay output 202 for both the condenser fans 108 and evaporator fans 109 as shown in FIG. 4. As can be seen from the electrical wiring diagram, the compressor 101, the condenser fans 108 and the evaporator fans 109 are wired separately to different relays 201, 202.

The programmable controller 200 turns the compressor 101 on and off by responding to a temperature sensor 203. As a result, the refrigeration system 100 regulates the air temperature in the wine cellar. Furthermore, the programmable controller 200 keeps the fans 108, 109 running after the compressor 101 stops for a settable time period, which restores the moisture to the wine cellar from the cold evaporator 106 and drip tray 107. The air humidity will be modulated using an open loop control by changing the duration of the fan running time.

In the preferred embodiment, the refrigeration system 100 employs a flow control device 105, (see FIG. 1) which can be a capillary tube, a thermostatic expansion valve, an electrically driven valve or another device. Alternatively, a heat exchanger, placed between a suction tube and a capillary tube can be used to enhance the performance.

In the preferred embodiment of the present invention (and referring back to FIG. 1), the condenser 103 and evaporator 106 are both finned-tube heat exchangers. The fins can be made of aluminum, copper or steel. Furthermore, the distance between fins needs to be designed for optimum heat transfer and water condensation dripping. The condensate drip tray 107 has over-flow passages 111.

As opposed to conventional, standard refrigeration systems, in which the water dripped from the cold heat exchanger needs to be removed, in the preferred embodiment of the present invention, the condensate drip tray 107 is designed in such a way that the water dripped from the evaporator 106 will stay in the evaporator 106 side and will not escape to the hot-gas tube 102 side immediately. As a result of this arrangement, only excessive water will be removed.

The main function of evaporator fans 109 is to circulate the air in the wine cellar over the evaporator 106 to transfer heat. When the compressor 101 runs, the temperature of the evaporator 106 will fall below the dew point of the air in the wine cellar, and the moisture in the air will condense. Consequently, the relative humidity of the air in the wine cellar will be reduced.

Furthermore, when the compressor stops, the temperature of the evaporator 106 will rise over the dew point, and the water will drip into the drip tray 107. If, after the compressor 101 stops, the fan 109 running time is set to 0, the preferred embodiment of the invention will function as a dehumidification unit.

In contrast, if, after the compressor 101 stops, the fans 109 running time is set to some arbitrary value, the preferred embodiment will function as a humidification unit by causing the condensate to evaporate. Depending on the surrounding conditions, setting the post compressor 101 fans 109 running time will adjust the humidity levels in the wine cellar. In the preferred embodiment, it has been found that if a temperature of 45° is to be maintained, a running time of 30 minutes is appropriate. Similarly, running times of 20 and 30 minutes are utilized to maintain temperatures of 55° and 60°, respectively.

Preferably, the programmable controller 200 is a digital controller having separate relay outputs 201, 202 for the compressor 101 and for both condenser fans 108 and evaporator fans 109, respectively. However, a separate electromechanical controller or a humidistat can be used to accomplish a similar purpose.

Figure 3:
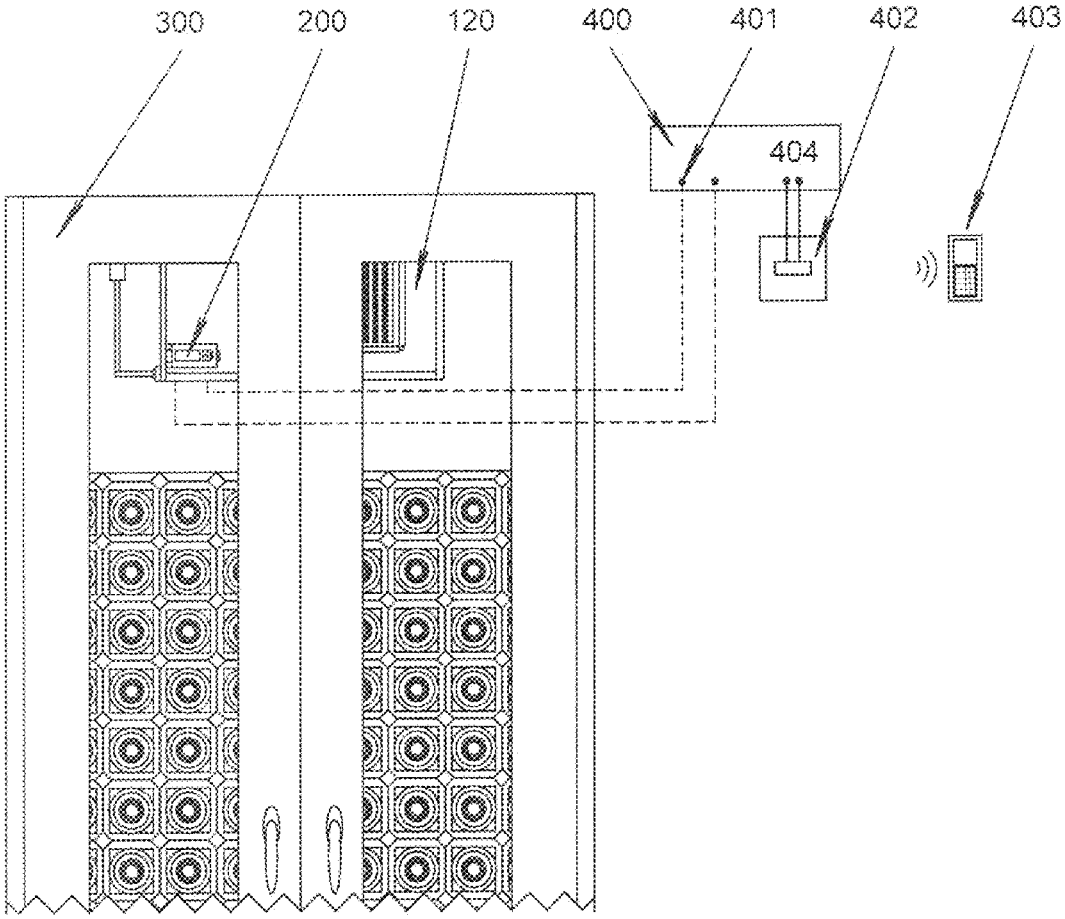
FIG. 3 is an idealized view of a wine cellar incorporating a preferred embodiment of the present invention.

Turning to FIG. 3, a wine cellar 300, as described in FIG. 1, is equipped with a programmable controller 200 which provides a signal to one relay 201 for the compressor 101 and to another relay output 202 for both the condenser fans 108 and evaporator fans 109 as shown in FIG. 4. As can be seen from the electrical wiring diagram of FIG. 4, the compressor 101, the condenser fans 108 and the evaporator fans 109 are wired separately to different relays 201, 202.

The programmable controller 200 turns the compressor 101 on and off by responding to a temperature sensor 203. As a result, and as explained above, the refrigeration system 100 regulates the air temperature in the wine cellar. Furthermore, the programmable controller 200 keeps the fans 108, 109 running after the compressor 101 stops for a settable time period, which restores the moisture from the wine cellar from the cold evaporator 106 and 107. The air humidity will be modulated by using an open loop control, responding to the humidity sensor 205 by changing the duration of the fan running time.

As a result, the climate control system 120 regulates the air temperature and humidity in the wine cellar 300 by turning on a refrigeration unit 100 when temperature exceeds an upper temperature limit and turning off the refrigeration unit 100 when the temperature reaches a preset lower limit. Similarly, the humidity is controlled by activating a humidifier (included in 120) when the humidity falls below a preset lower limit and deactivates the humidifier when humidity reaches the desired value.

An automatic dialer 400 is connected to the programmable controller 200 through a relay 401 in FIG. 3. Also the automatic dialer 400 is connected to a telephone line through a wall jack 402, or if it is so equipped, a wireless communication device that can transmit signals.

In case the air temperature or humidity are outside the desired levels, which are set by the temperature and humidity processing device 200, the relay 401 is triggered to energize the automatic dialer 400, calling one or more phone numbers preselected by the wine owner. One potential recipient is the owner's own personal cell phone which receives a recorded warning message.

Therefore, the advantage of the present invention is to provide a method and apparatus to notify predetermined recipients in case the air temperature or humidity are beyond the desired levels.

Figure 5:
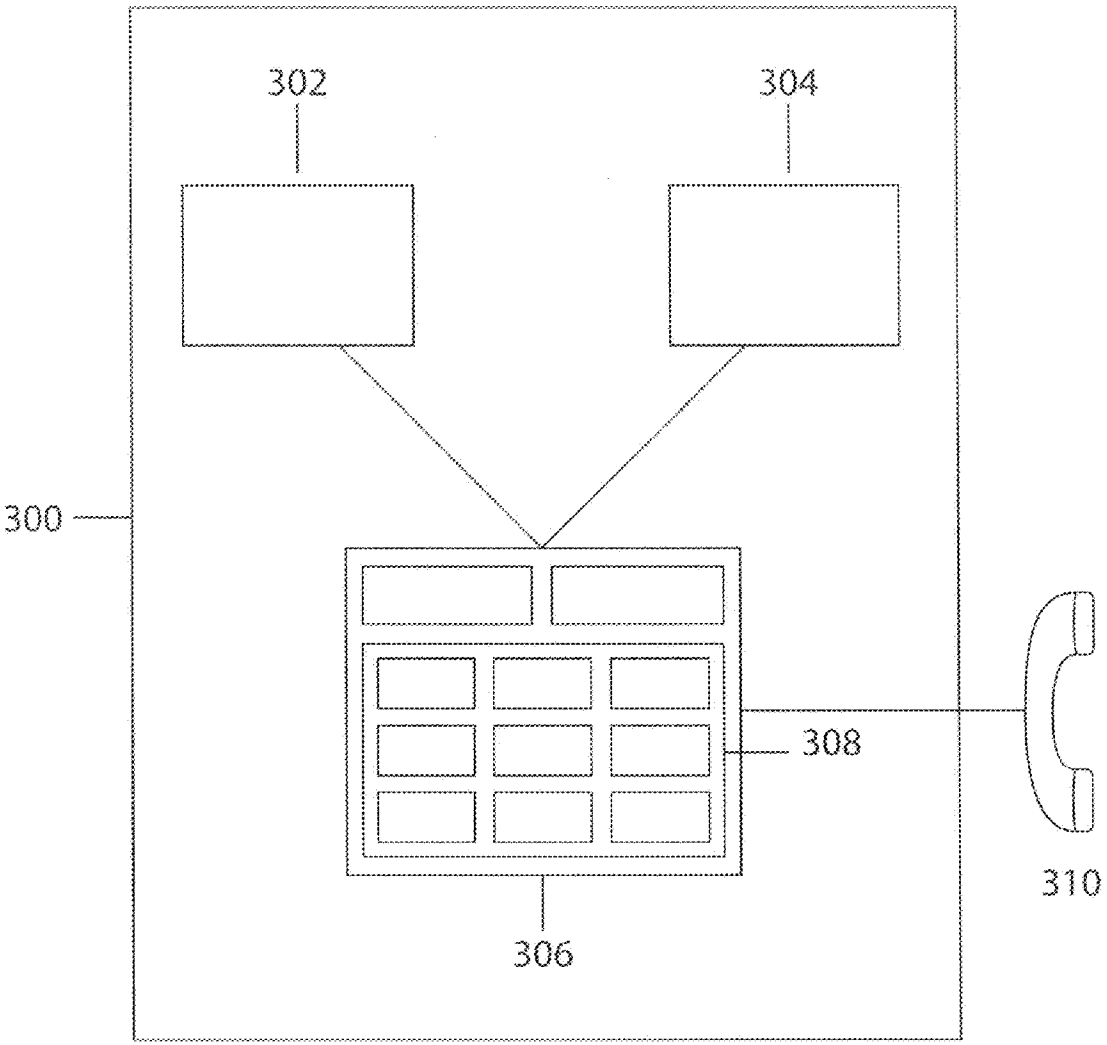
FIG. 5 is a block diagram of the components of a wine cellar alarm system according to a preferred embodiment of the present invention.

FIG. 5 shows a block diagram of the preferred embodiment of the device. The controlled environment storage device, preferably a wine cellar 300 contains a temperature sensor 302, a humidity sensor 304, a processing device 306 and a phone dialer 310 outside of the wine cellar 300. The temperature sensor and humidity sensor each sends a temperature value and humidity value respectively to the processing device 306. The processing device contains an input keypad 308, so that the user can enter in a set of values which will form the temperature and humidity limits. If the values coming from the sensors are beyond the user defined limits, then the processing device 306 will trigger a phone dialer 310 that calls one or more pre-selected numbers.

Figure 6:
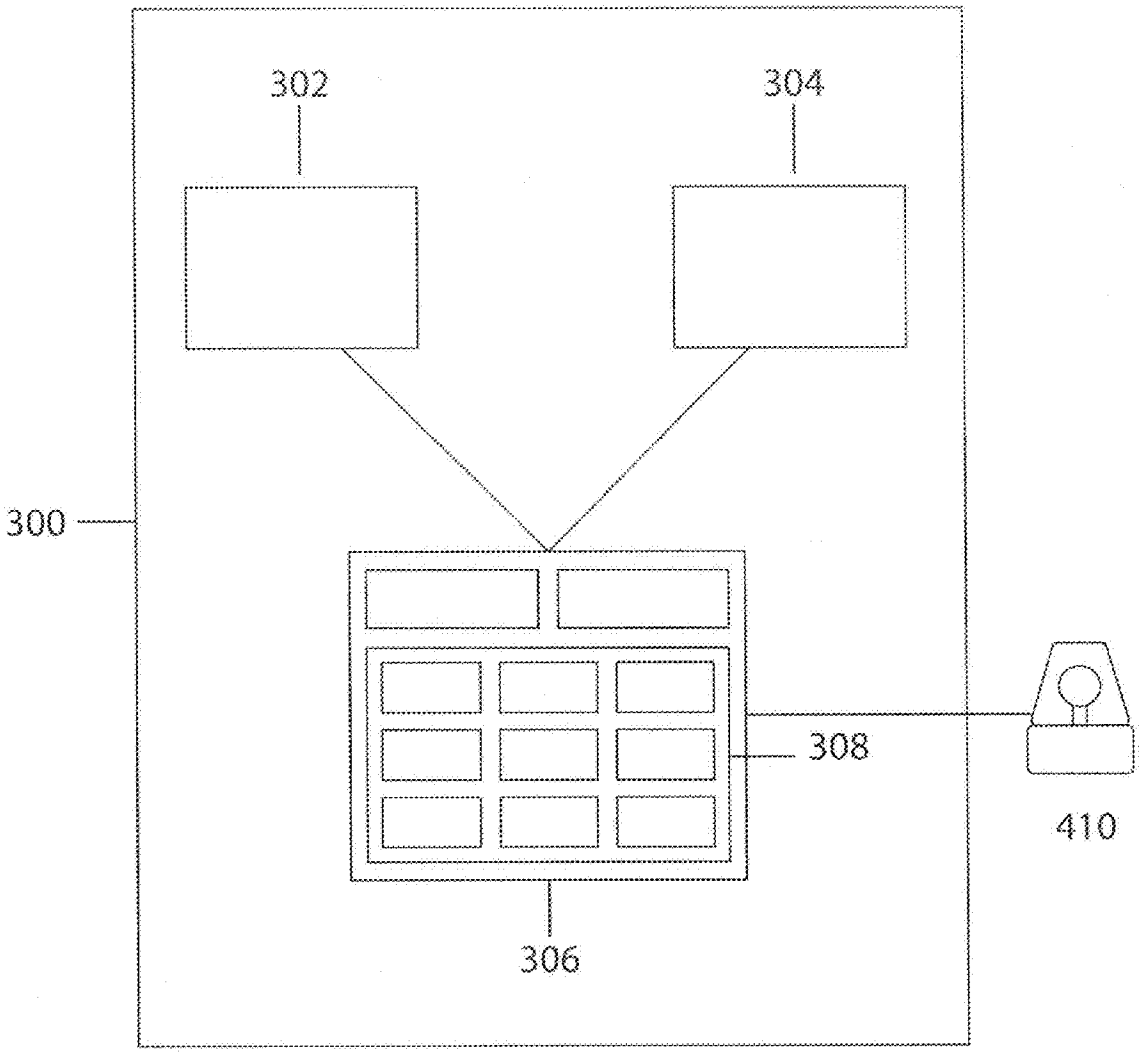
FIG. 6 is a block diagram of a wine cellar alarm system according to an alternative embodiment of the present invention.

FIG. 6 shows a block diagram of an alternative embodiment of the device. It contains all the components of FIG. 5, with the exception of the phone dialer 310. In the place of the phone dialer 310, the controlled environment storage device, preferably a wine cellar 300 contains a visual alarm 410 which generates a light signal as an alarm.

Figure 7:
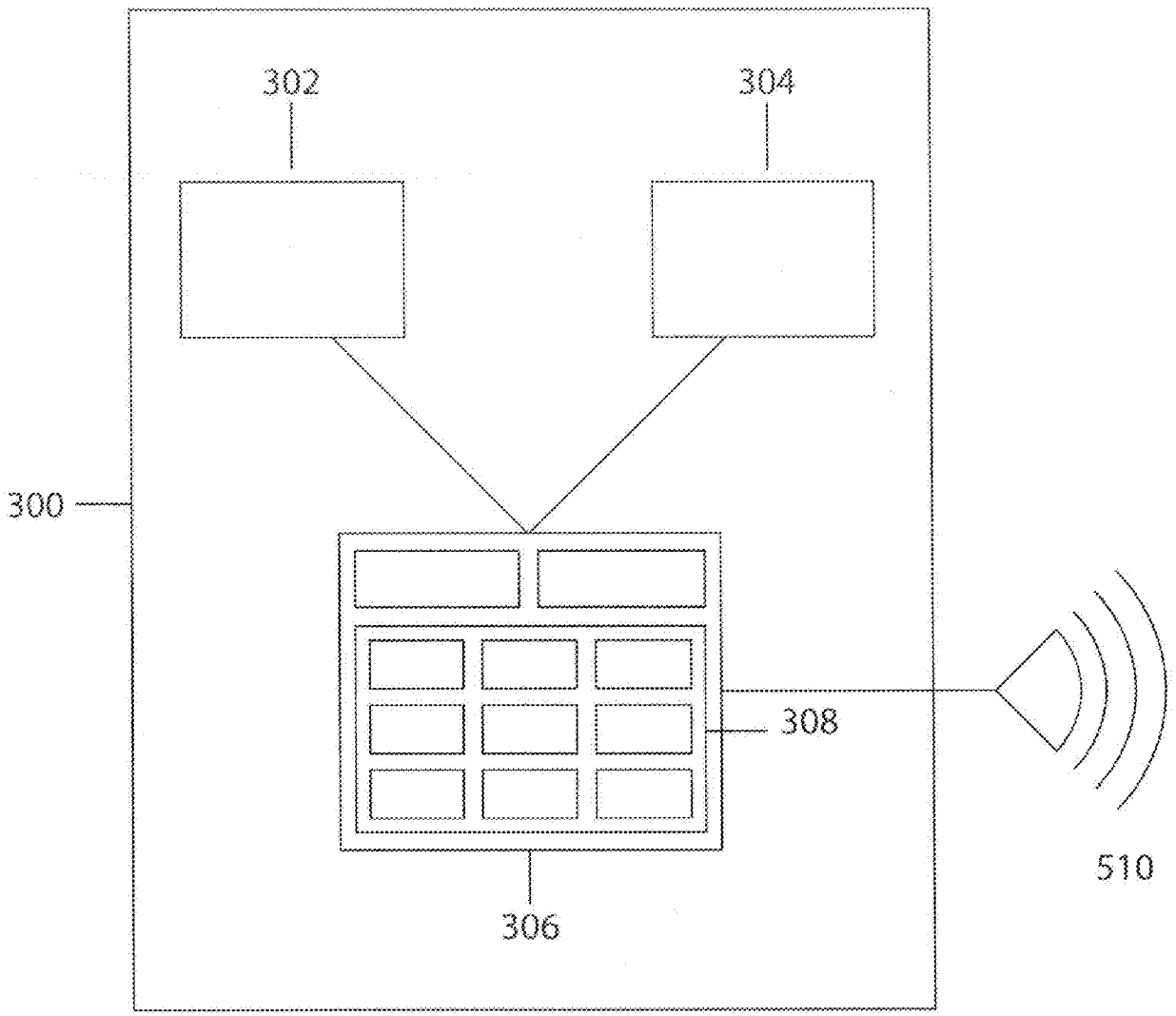
FIG. 7 is a block diagram of a wine cellar alarm system according to another alternative embodiment of the present invention.

FIG. 7 shows a block diagram of yet another alternative embodiment of the device. It contains all the components of FIG. 5, with the exception of the phone dialer 310. In the place of the phone dialer 310, the controlled environment storage device, preferably a wine cellar 300 contains an audible alarm 510 which emits a sound.

The preferred embodiment of this invention is particularly suited to a "reach-in" wine cellar in which the air temperature and relative humidity need to be maintained at a desired value. However, it is to be understood that various modifications may be used without departing from the principle of the present invention scope.

What is claimed as new is:

1. A wine cellar alarm system comprising:

a programmable controller for regulating wine cellar air temperature and humidity;

a wine cellar temperature sensor connected to said programmable controller for signaling air temperature in the wine cellar;

a wine cellar humidity sensor connected to said programmable controller for signaling air humidity in the wine cellar;

alarm means in said programmable controller for generating an alarm signal when sensed wine cellar temperature and humidity levels are outside of preset limits; and communication means, connected to said alarm means, for transmitting alarm messages to predetermined recipients in response to said alarm signals such that recipients are immediately notified of the alarm and wherein notifications are given when wine cellar temperature and humidity values are outside of preset limits.

2. An alarm system in accordance with claim 1, wherein said communication means include an automatic telephone dialer.

3. An alarm system in accordance with claim 2, wherein said dialer is connected to a telephone system.

4. An alarm system in accordance with claim 2, wherein said dialer is connected to a cellular telephone system.

5. An alarm system in accordance with claim 1, wherein said alarm means are connected to an audible alarm device.

6. An alarm system in accordance with claim 1, wherein said alarm means are connected to a visible alarm display device.

7. An alarm system in accordance with claim 1 wherein said wine cellar temperature sensor detects bottle temperature.

8. An alarm system in accordance with claim 1 wherein said communication means include telephone means capable of connecting to preselected recipients.

9. A wine cellar alarm system comprising:

a. temperature sensing means connected to a the wine cellar for determining and signalling air temperatures therein;

b. humidity sensing means connected to the wine cellar for determining and signaling humidity therein;

c. temperature limit setting means coupled to said temperature sensing means including means for setting acceptable temperature fluctuation limits;

d. humidity limit setting means coupled to said humidity sensing means for setting acceptable humidity fluctuation limits;

e. alarm means coupled to said limit setting means and said sensing means for generating an alarm signal when fluctuation limits are exceeded; and f. communication means, coupled to said alarm means for transmitting a predetermined message to selected recipients in response to alarm signals from said alarm means such that recipients are immediately notified of the alarm.

10. An alarm system as in claim 9 wherein said communication means include a dialer adapted to be connected to a telephone system for alerting selected recipients.

11. An alarm system as in claim 9 wherein said communication means include a cellular telephone programmed to contact selected recipients.

12. An alarm system as in claim 9 wherein said communication means include means for signaling an audible alarm system.

13. An alarm system as in claim 9 wherein said communication means include means for signaling a visible alarm system including a display device.

* * * * *